US006109810A

United States Patent [19]

Flores et al.

[11] Patent Number: 6,109,810

[45] Date of Patent: Aug. 29, 2000

[54] CONDIMENT BOTTLE TOP

[76] Inventors: Al Flores, 17138 Oporto, Livonia, Mich. 48152; Glenn J. Cox, 3480 Edsel St., Trenton, Mich. 48183

[21] Appl. No.: 09/064,542

[22] Filed: Apr. 22, 1998

Related U.S. Application Data

[60] Provisional application No. 60/044,612, Apr. 24, 1997.

[51] Int. Cl.[7] ..... A46B 11/04

[52] U.S. Cl. ..... 401/279; 401/14; 401/15

[58] Field of Search ..... 401/279, 280, 401/14, 15, 270, 278, 268

[56] References Cited

U.S. PATENT DOCUMENTS

| | | | |
|---|---|---|---|
| D. 366,151 | 1/1996 | Norris . | |
| 370,452 | 9/1887 | Crooker | 401/279 |
| 1,726,305 | 8/1929 | Lysons | 401/280 X |
| 2,167,523 | 7/1939 | Reichenbach | 401/15 |
| 2,253,779 | 8/1941 | Gutierrez | 401/15 |
| 2,625,302 | 1/1953 | Mahoney | 401/280 X |
| 2,748,411 | 6/1956 | O'Brien | 401/15 |
| 4,066,367 | 1/1978 | Sherosky . | |
| 4,693,519 | 9/1987 | Lewis, Jr. . | |
| 4,712,936 | 12/1987 | Kessler . | |
| 4,726,386 | 2/1988 | Schultz . | |
| 4,772,073 | 9/1988 | Lewis, Jr. . | |
| 4,841,996 | 6/1989 | Gueret . | |
| 5,116,154 | 5/1992 | Fulkerson . | |
| 5,165,759 | 11/1992 | Lewis, Jr. . | |
| 5,186,559 | 2/1993 | Fu . | |
| 5,397,195 | 3/1995 | Goncalves . | |
| 5,547,303 | 8/1996 | Pyrozyk . | |
| 5,570,966 | 11/1996 | Phelan . | |
| 5,597,255 | 1/1997 | Yager et al. . | |
| 5,716,104 | 2/1998 | Keating et al. . | |

FOREIGN PATENT DOCUMENTS

| | | | |
|---|---|---|---|
| 407102 | 3/1934 | United Kingdom | 401/280 |

*Primary Examiner*—David J. Walczak
*Attorney, Agent, or Firm*—Harness, Dickey & Pierce, PLC

[57] ABSTRACT

A replacement top is provided for a condiment bottle. The replacement top includes a cap member adapted to be received on an opening of a bottle. The cap member includes a fluid passage therethrough. A valve member is supported by the cap member for operatively opening and closing the fluid passage in the cap member. A brush portion is attached to the cap member in proximity to the fluid passage.

20 Claims, 1 Drawing Sheet

CONDIMENT BOTTLE TOP

This application claims benefit to U.S. Provisional No. 60/044,612 filed Apr. 24, 1997.

BACKGROUND OF THE INVENTION

1. Field of the Invention

The present invention relates to a replacement cap for condiment bottles, and more particularly to a replacement cap having a built-in brush applicator for dispensing fluid from a container.

2. Background and Summary of the Invention

When cooking meats, or other food items, a condiment such as barbecue sauce, catsup, or marinate is often applied to enhance flavor. Some chefs prefer to spread the condiment over the food item for even distribution to obtain a more consistent flavor. Present practice is to use a small brush to achieve such spreading.

The use of a brush requires yet another cooking utensil to be kept in inventory and about the cooking area when its use is required. This creates an inconvenience to the chef and can promote unsanitary conditions as the brush is often placed on a counter top after use, which transfers a small amount of condiment to the counter top, giving ways to a breeding area for bacteria. Accordingly, it has been recognized that it is desirable to provide a combined dispenser and applicator for applying condiments to foods. For example, U.S. Pat. No. 5,547,303 issued to Pyrozyk on Aug. 20, 1996, discloses an apparatus for dispensing and applying food from a container. The apparatus includes a conduit, a brush head, and a coupling. The conduit extends through an opening in the coupling and is provided in fluid communication with the container. The brush head has bristles, a fluid receiving opening for receiving the fluid and a fluid dispersing opening in communication with the fluid receiving opening for dispersing the fluid amongst the bristles. The brush head is movably secured to the coupling and movable between first and second positions relative to the coupling. The coupling has a plug operable to plug the food receiving opening to prevent fluid from flowing from the conduit into the food receiving opening when the brush head is in the first position and to permit fluid to flow from the conduit into the fluid receiving opening when the brush head is in the second position. The problem with the design of the disclosed device is that grease and other food particles from the items being cooked are able to run back into the bottle when the bottle is returned to an upright position. This is due to the fact that the fluid receiving opening between the brush head and the conduit remains open unless the brush head is manually returned to the closed position. This creates an unsanitary condition for allowing bacteria to breed inside of the bottle.

Accordingly, the present invention provides a replacement top having a valve member which automatically closes when the bottle is not in use. Thus, the unsanitary condition of allowing grease to flow back into the bottle is prevented.

According to the present invention, a replacement top is provided for a condiment bottle. The replacement top includes a cap member adapted to be received on an opening of a bottle. The cap member includes a fluid passage therethrough. A valve member is supported by the cap member for operatively opening and closing the fluid passage in the cap member. A brush portion is attached to the cap member in proximity to the fluid passage. The valve member traverses the fluid passage in a closed position. The valve member is operatively attached to an actuator mechanism for moving the valve member between an open and a closed position. A spring is provided for biasing either the valve member or the actuator mechanism to the closed position.

According to the present invention, the valve of the replacement top closes during brushing of the fluid on the item being cooked so that grease and other food particles do not run into the bottle creating an unsanitary condition.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
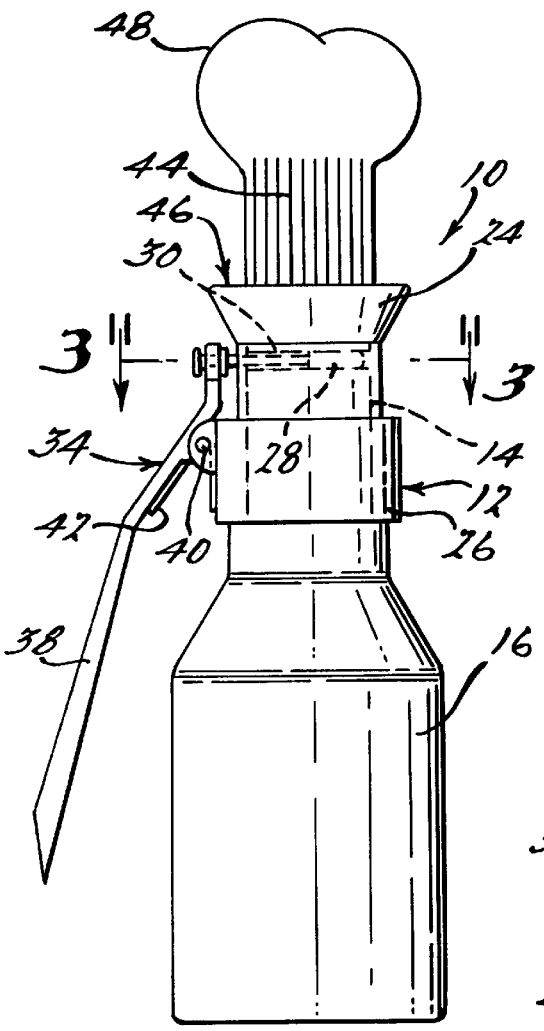
FIG. 1 is a side view of a replacement bottle top according to the principles of the present invention applied to a standard condiment bottle.
Figure 2:
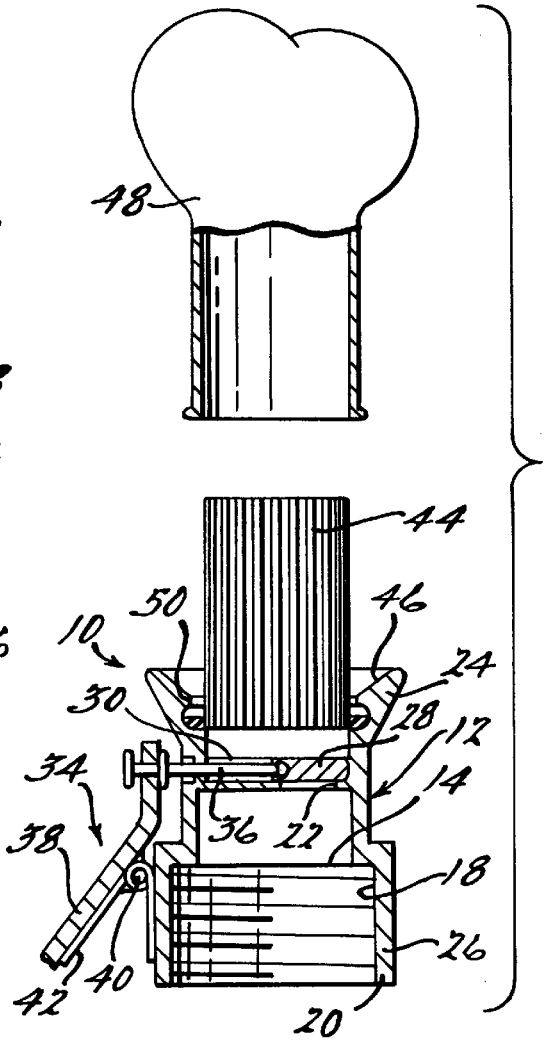
FIG. 2 is a cross-sectional view of a replacement bottle top according to the principles of the present invention applied to a threaded opening of a standard condiment bottle.
Figure 3:
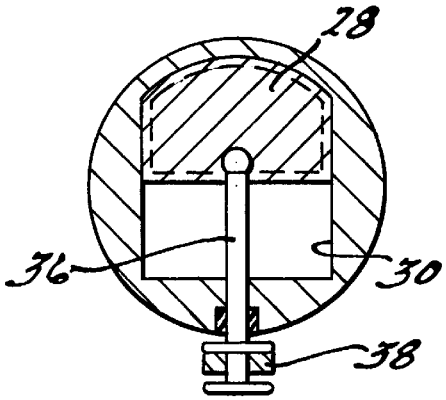
FIG. 3 is a cross-sectional view taken along line 3—3 of FIG. 1, showing the valve mechanism in a closed position.
Figure 4:
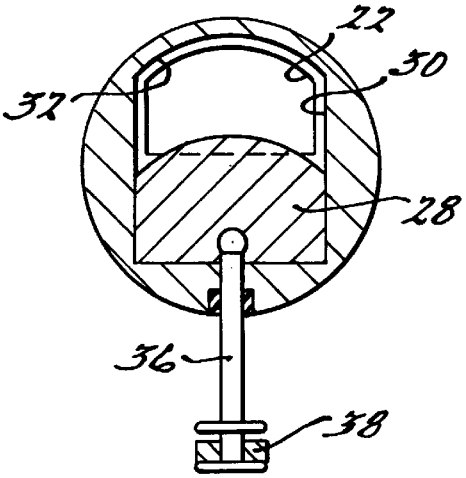
FIG. 4 is a cross-sectional view similar to FIG. 3 but showing the valve mechanism in an open position.

With reference to FIGS. 1–4, replacement bottle top 10 of the present invention will now be described. The bottle top 10 includes a cap member 12 adapted to be received on an opening 14 of a bottle 16. Cap member 12 includes an internally threaded portion 18 which is designed to engage external threads 20 of the bottle opening 14. Cap member 12 includes a fluid passage 22 between first and second ends 24, 26 of cap member 12.

A valve member 28 is provided in the fluid passage 22 for operatively opening and closing the fluid passage 22. Valve member 28 is disposed in a valve chamber 30 which includes a valve seat 32 disposed in one end portion thereof. Valve member 28 is attached to an actuator mechanism 34 for operatively opening and closing fluid passage 22. Actuator mechanism 34 includes a pin member 36 attached to valve member 28 at a first end thereof. A lever arm 38 is attached to the cap member 12 at a pivot 40. Lever arm 38 is attached to a second end of pin member 36. Lever arm 38 is biased to a first position corresponding to a closed position of the valve member 28 by spring 42.

The second end 26 of cap member 12 is provided with a brush portion 44 including a plurality of bristles securely mounted to the cap member 12 by conventional bristle attachment methods. A dished area 46 surrounds the base of the brush portion 44. The dished area 46 is provided for preventing spills or leakage of the fluid down the outer surface of the cap member 12 or bottle 14. A removable cover 48 is provided for covering the brush portion 44 when not in use. The removable cover 48 can have various shapes. The removable cover 48 as shown is in the shape of a chefs hat.

In operation, the conventional cap of the condiment bottle 16 is removed and the replacement bottle top 10 of the present invention is secured to the bottle 16. The replacement bottle top 10 can be threadedly attached as shown in FIG. 1, or can be snap fitted or attached by other known methods depending upon the design of the bottle opening 14. The bottle 16 is then turned upside down so that the fluid runs to the opening end of the bottle 16 and the actuator mechanism 34 is activated in order to move the valve member 28 to an open position thereby opening the fluid passage 22. As the fluid passes through the fluid passage 22, the fluid runs along the bristles of the brush portion 44 so that the fluid can be brushed onto the items being cooked. Actuator mechanism 34 can be controllably operated to control the amount of fluid delivered to the brush portion 44 of the bottle top 10. Typically, when enough fluid is dispensed, the operator will release the actuator mechanism 34 thus closing the passage 22. The dispensed fluid will continually be brushed onto the item being cooked and the bottle 16 is then returned to its upright position.

Because the valve member 28 has closed the fluid passage 22, grease or other food particles are prevented from flowing back into the bottle 16. During preparation of the food, the brush portion 44 can be covered with the removable cover 48. Removable cover 48 preferably snaps into engagement with an internal rib portion 50 disposed adjacent to dished area 46. The fluid that remains on the brush portion 44 will be captured by the dished area 46 surrounding the brush portion 44. When the cooking is complete, the brush portion 44 and dished area 46 can be placed under hot water and rinsed out, or the bottle top 10 can be removed from the bottle 16 and washed.

Because the fluid passage 22 of the bottle top 10 is automatically closed upon release of the actuator mechanism 34, contamination of the fluid in the bottle 16 by grease and other food particles is more readily prevented. In prior art devices, the nozzle or cap is required to be lifted upward to open the passageway and pressed downward in order to close the passageway. With these devices, it is common for a user to inadvertently leave the cap in the open position when the bottle is returned to the upright position, thereby allowing the fluid to be contaminated.

Another advantage of the present invention is that the actuator mechanism 34 can be used to regulate the amount of fluid flow from the bottle 15 by adjustably controlling the opening size of the fluid passage 22. Contrary to this, with other known brush-type dispenser caps, the fluid flow cannot be regulated by adjustably controlling a valve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bottle top for food condiments comprising:

a cap defining a fluid passage therethrough;

a valve assembly supported by said cap for operatively opening and closing said fluid passage in said cap said valve assembly being controllably operated by a spring biased lever arm during manipulation by a user of a bottle to control the release of a desired amount of condiment from the bottle;

a brush attached to said cap in proximity to said fluid passage; and a means for prohibiting spills or leakage from dripping down the outside surface of said cap, said means adjacent and substantially surrounding said brush.

2. The bottle top according to claim 1, wherein said means for prohibiting spills includes a dished area substantially surrounding said brush.

3. The bottle top according to claim 1, wherein said cap includes an internally threaded portion for engaging a threaded opening of a bottle.

4. The bottle top according to claim 1, further comprising a removable cover for covering said brush.

5. The bottle top according to claim 1 wherein said valve assembly includes a valve member movable between an open position and a closed position, said valve member being movable to an intermediate position between said open and said closed positions to progressively open said fluid passage.

6. The bottle top according to claim 1, wherein said valve assembly includes an actuator mechanism for moving a valve member between an open and a closed position.

7. The bottle top according to claim 6 wherein said actuator mechanism is capable of moving said valve member to an intermediate position between said open and closed positions to partially open said fluid passage.

8. The bottle top according to claim 1, further comprising a spring for biasing said valve assembly to close said fluid passage.

9. A bottle top for food condiments comprising;

a cap defining a fluid passage therethrough;

a valve assembly supported by said cap, said valve assembly movable between an open position where said fluid passage is open, a closed position where said fluid passage is closed and an intermediate position between said open and closed positions where said fluid passage is partially open and said valve assembly being controllably operated by a spring biased lever arm during manipulation by a user of a bottle to control the release of a desired amount of condiment from the bottle;

a brush attached to said cap adjacent said fluid passage; and a member for prohibiting spills or leakage from dripping down the outside of the cap, said member being adjacent and substantially surrounding said brush.

10. The bottle top according to claim 9, wherein said member includes a dished area substantially surrounding said brush.

11. The bottle top according to claim 9, wherein said cap includes an internally threaded portion for engaging a threaded opening of a bottle.

12. The bottle top according to claim 9, further comprising a removable cover for covering said brush.

13. The bottle top according to claim 9, further comprising a spring for biasing said valve assembly to said closed position.

14. A bottle top for food condiments comprising:

a cap defining a fluid passage therethrough;

a valve member slidably disposed with respect to said cap, said valve member movable between an open position where said fluid passage is open and a closed position where said fluid passage is closed and said valve assembly being controllably operated by a spring biased lever arm during manipulation by a user of a bottle to control the release of a desired amount of condiment from the bottle;

a brush attached to said cap adjacent said fluid passage; and a member for prohibiting spills or leakage from dripping down the outside of the cap, said member being adjacent and substantially surrounding said brush.

15. The bottle top according to claim 14, wherein said member includes a dished area substantially surrounding said brush.

16. The bottle top according to claim 14, wherein said cap includes an internally threaded portion for engaging a threaded opening of a bottle.

17. The bottle top according to claim 14, further comprising a removable cover for covering said brush.

18. The bottle top according to claim 14 wherein said valve member is movable to an intermediate position between said open and closed positions to partially open said fluid passage.

19. The bottle top according to claim 14 further comprising a spring for biasing said valve member into said closed position.

20. The bottle top according to claim 19 wherein said spring is disposed between said cap and said lever arm.

* * * * *